US006672487B1

(12) United States Patent
Lohrman

(10) Patent No.: US 6,672,487 B1
(45) Date of Patent: Jan. 6, 2004

(54) FLUID DISPENSING CLOSURE, PACKAGE AND METHOD OF MANUFACTURE

(75) Inventor: Richard D. Lohrman, Sylvania, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/164,948

(22) Filed: Jun. 7, 2002

(51) Int. Cl.[7] ..... B65D 5/72

(52) U.S. Cl. ..... 222/213; 222/1; 222/212; 222/490; 222/494; 222/546

(58) Field of Search ..... 222/206, 212, 222/213, 215, 490, 491, 494, 545, 546, 1

(56) References Cited

U.S. PATENT DOCUMENTS

| | | | | |
|---|---|---|---|---|
| 2,758,755 A | | 8/1956 | Schafler | |
| D221,132 S | | 7/1971 | Schiavone | |
| 4,133,457 A | | 1/1979 | Klassen | |
| 4,728,006 A | | 3/1988 | Drobish | |
| 4,749,108 A | | 6/1988 | Dornsbusch | |
| 4,991,745 A | | 2/1991 | Brown | |
| 5,005,737 A | | 4/1991 | Rohr | |
| 5,033,655 A | | 7/1991 | Brown | |
| 5,071,017 A | | 12/1991 | Stull | |
| 5,115,950 A | | 5/1992 | Rohr | |
| 5,143,236 A | | 9/1992 | Gueret | |
| D331,874 S | | 12/1992 | Schmidt | |
| 5,213,236 A | | 5/1993 | Brown | |
| 5,234,138 A | | 8/1993 | De Laforcade | |
| 5,271,531 A | | 12/1993 | Rohr | |
| D343,791 S | | 2/1994 | Pitaknarongphorn | |
| 5,320,254 A | * | 6/1994 | Ranalletta et al. | 222/189.08 |
| 5,339,995 A | | 8/1994 | Brown | |
| 5,377,877 A | | 1/1995 | Brown | |
| 5,390,805 A | | 2/1995 | Bilani | |
| 5,409,144 A | | 4/1995 | Brown | |
| 5,439,143 A | | 8/1995 | Brown | |
| 5,531,363 A | | 7/1996 | Gross | |
| 5,568,886 A | | 10/1996 | Knickerbocker | |
| 5,590,835 A | | 1/1997 | Rosenthal | |
| 5,632,420 A | | 5/1997 | Lohrman | |
| 5,676,289 A | | 10/1997 | Gross | |
| 5,680,969 A | | 10/1997 | Gross | |

(List continued on next page.)

FOREIGN PATENT DOCUMENTS

| | | |
|---|---|---|
| DE | 29706456 | 4/1997 |
| EP | 0442379 | 8/1991 |
| EP | 0713832 | 5/1996 |
| EP | 0816245 | 1/1998 |
| EP | 0841258 | 5/1998 |
| EP | 1216932 | 6/2002 |

OTHER PUBLICATIONS

Photographs of "Wesson" closure in the file of U.S. 5,954, 237 (dated unknown).

*Primary Examiner*—J. Casimer Jacyna

(57) ABSTRACT

A dispensing package for fluid products includes a container having a body for holding a product to be dispensed and a finish having an open mouth. A closure base includes a ledge with a skirt externally secured to the container finish and a wall extending from the ledge coaxially with the container mouth. A collar has a deck with a central opening aligned with the mouth, and a wall secured to the wall on the closure base. A lid is integrally connected to the collar or the base by at least one hinge. A dispensing valve of flexible resilient elastomeric construction has a peripheral portion captured between the collar deck and the base wall for securing the valve in position and simultaneously functioning as a seal between the base and the collar. An intermediate portion of the valve is in facing engagement with the collar deck, and an annular wall portion of the valve extends from the inner end of the intermediate portion. An inner portion of the valve extends radially inwardly from the annular wall portion and has at least one dispensing slit for dispensing product from the container.

81 Claims, 6 Drawing Sheets

U.S. PATENT DOCUMENTS

| | | | |
|---|---|---|---|
| 5,743,443 | A | 4/1998 | Hins |
| 5,788,108 | A | 8/1998 | Rohr |
| 5,794,308 | A | 8/1998 | Rentsch |
| 5,819,984 | A | 10/1998 | Krueger |
| 5,839,626 | A | 11/1998 | Gross |
| D406,533 | S | 3/1999 | Maus |
| 5,897,033 | A | 4/1999 | Okawa |
| 5,927,549 | A | 7/1999 | Wood |
| 5,927,566 | A | 7/1999 | Mueller |
| 5,927,567 | A | 7/1999 | Fillmore |
| 5,934,512 | A | 8/1999 | Lampe |
| 5,934,514 | A | 8/1999 | Lampe |
| 5,938,086 | A | 8/1999 | Gross |
| 5,938,087 | A | 8/1999 | Randall |
| 5,944,234 | A | 8/1999 | Lampe |
| 5,954,237 | A | 9/1999 | Lampe |
| 5,971,232 | A | 10/1999 | Rohr |
| 6,006,960 | A | 12/1999 | Gross |
| 6,041,477 | A | 3/2000 | Rentsch |
| 6,065,642 | A | 5/2000 | Brown |
| 6,089,411 | A | 7/2000 | Baudin |
| 6,095,382 | A | 8/2000 | Gross |
| 6,112,951 | A | 9/2000 | Mueller |
| 6,176,399 | B1 | 1/2001 | Schantz |
| 6,186,374 | B1 | 2/2001 | Gross |
| 6,213,355 | B1 | 4/2001 | Schwanenberg |
| 6,230,940 | B1 | 5/2001 | Manning |
| 6,273,296 | B1 | 8/2001 | Brown |
| 6,279,783 | B1 | 8/2001 | Brown |
| 6,290,108 | B1 | 9/2001 | Gross |
| 6,321,947 | B2 | 11/2001 | Gross |
| 6,334,555 | B1 | 1/2002 | Randall |
| 6,349,860 | B1 | 2/2002 | McMahon |

* cited by examiner

FLUID DISPENSING CLOSURE, PACKAGE AND METHOD OF MANUFACTURE

The present invention is directed to valved dispensing closures for fluid products such as beverages, food condiments and body lotions, to fluid dispensing packages that include such a closure, and to methods for making such a closure.

BACKGROUND AND OBJECTS OF THE INVENTION

U.S. Pat. No. 5,927,567 discloses a dispensing closure, package and method of manufacture in which a flexible resilient valve is positioned within a closure body for securement to a container finish. The valve has a central portion with dispensing slits. When the container body is squeezed, the central portion of the valve flexes outwardly to open the slits and dispense fluid product through the slits. When the container body is released, resiliency of the central portion of the valve closes the dispensing slits. A general object of the present invention is to provide an improved dispensing closure assembly of this character, an improved package embodying such a closure assembly, and an improved method for manufacture of the closure assembly.

A dispensing package for fluid products in accordance with one aspect of the present invention includes a container having a body for holding a product to be dispensed and a finish having an open mouth. A closure base includes a ledge with a skirt externally secured to the container finish and a wall extending from the ledge coaxially with the container mouth. A collar has a deck with a central opening aligned with the mouth, and a wall secured to the wall on the closure base. A lid is integrally connected to the collar or the base by at least one hinge. A dispensing valve of flexible resilient elastomeric construction has a peripheral portion captured between the collar deck and the wall on the base for securing the valve in position and simultaneously functioning as a seal between the base and the collar. An intermediate portion of the valve is in facing engagement with the collar deck, and an annular wall portion of the valve extends from the inner end of the intermediate portion. An inner portion of the valve extends radially inwardly from the annular wall portion and has at least one dispensing slit for dispensing product from the container.

A dispensing closure assembly in accordance with another aspect of the present invention includes a closure base with a ledge and a skirt for external securement to a container finish, and a wall extending from the ledge. A collar has a deck with a central opening, and a wall externally surrounding and secured to the wall on the base. A lid is integrally connected to the collar or the base by at least one hinge. A dispensing valve of flexible resilient elastomeric construction has a peripheral portion captured between the collar deck and the wall on the base for securing the valve in position and simultaneously functioning as a seal between the base and the collar. The valve includes an intermediate portion in facing engagement with the collar deck, and an annular wall portion extending from an inner end of the intermediate portion. The dispensing valve has an inner portion extending radially inwardly from the annular wall portion with at least one slit for dispensing product through the closure assembly.

A method of making a dispensing closure assembly in accordance with yet another aspect of the present invention includes providing a closure base of molded plastic construction having a ledge with a skirt for external securement to a container finish, a cylindrical wall extending from the ledge and a bead around the cylindrical wall. A dispensing valve is placed against an end of the cylindrical wall on the closure base. The dispensing valve is of flexible resilient elastomeric construction having a peripheral portion engaged with an end of the cylindrical wall of the closure base, an intermediate portion, an annular wall portion extending from an inner end of the intermediate portion, an inner portion extending radially inwardly from the annular wall portion, and at least one dispensing slit in the inner portion. A collar is secured to the cylindrical wall of the closure base. The collar has a deck opposed to and engaged with the peripheral portion of the valve such that the peripheral portion of the valve functions as a seal between the base and the collar. The collar includes a bead secured over the bead on the cylindrical wall of the base. A lid is integrally connected to the collar or the base by spaced hinges for pivoting between positions overlying and spaced from the valve.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
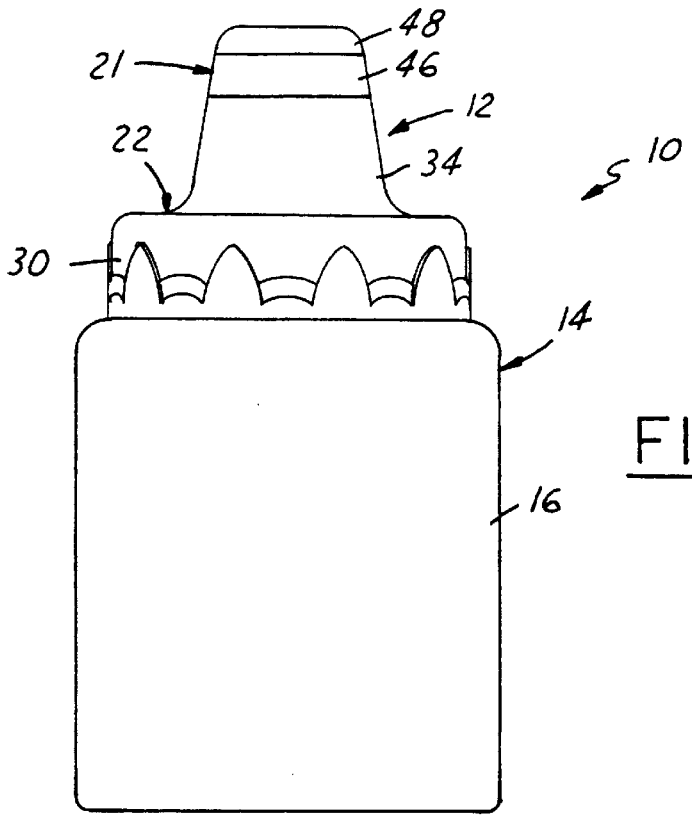
FIG. 1 is a side elevational view of a dispensing package in accordance with a presently preferred embodiment of the invention.
Figure 2:
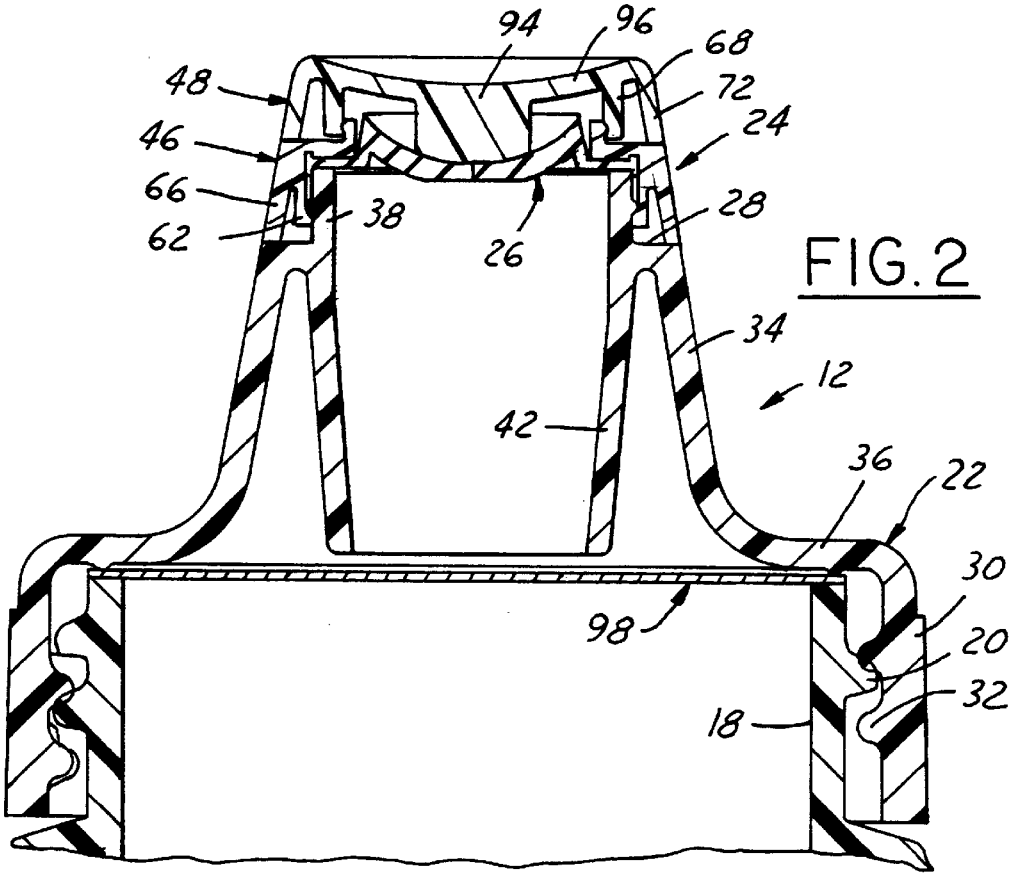
FIG. 2 is a fragmentary sectional view diametrically bisecting the package of FIG. 1.

FIGS. 1 and 2 illustrate a closure and container dispensing package 10 in accordance with one presently preferred embodiment of the invention as comprising a closure assembly 12 secured to a container 14. Container 14 is preferably of one-piece integrally molded plastic construction having a flexible resilient body 16 for holding product to be dispensed and a cylindrical finish 18 that surrounds and defines the container mouth. Finish 18 includes one or more external threads or beads 20 for securing closure assembly 12 to the container.

Closure assembly 12 in this embodiment of the invention includes a closure base 22, a closure 24 and a dispensing valve 26. Closure base 22 includes a flat axially facing annular base wall or ledge 28 from which a peripheral skirt 30 depends. Skirt 30 has one or more internal threads or beads 32 for cooperating with external threads or beads 20 on container finish 18 to secure the closure assembly to the container finish. Skirt 30 is connected to ledge 28 by a conical outer wall 34 that extends axially downwardly and radially outwardly from ledge 28, and a flat base 36 that extends radially outwardly from the lower end of conical wall 34 to the upper end of peripheral skirt 30. (Directional words such as "upper" and "lower" are used by way of description and not limitation with respect to the upright orientation of the closures and packages illustrated in the drawings. Directional words such as "axial," "radial" and "lateral" are taken with respect to the central axis of the closure, which is preferably coaxial with the axis of the container finish. Directional words such as "inwardly" and "outwardly" are taken with respect to the package interior.) A cylindrical wall 38 extends axially outwardly and upwardly from ledge 28 coaxially with the container finish and the container mouth defined by the finish. An annular bead 40 surrounds and extends radially outwardly from cylindrical wall 38 at a position spaced from the upper end of the wall. Bead 40 may be circumferentially continuous or segmented. An inner wall 42 extends axially downwardly from ledge 28 forming a continuation of cylindrical wall 38. Wall 42 is illustrated in FIG. 2 as having an upper cylindrical portion and a lower conical portion that tapers axially and radially inwardly away from annular wall 38.

Closure 24 includes a collar 46 and a lid 48 integrally interconnected to the collar by a pair of laterally spaced snap hinges 50, 52. Snap hinges 50, 52 are preferably of the type illustrated in U.S. Pat. Nos. 5,794,308 and 6,041,477. Collar 46 has a flat axially facing base wall or deck 54 with a central opening 56 that is aligned in assembly with the mouth of the container. A first cylindrical wall 58 surrounds opening 56 and extends axially outwardly from an inner edge of deck 54—i.e., away from the mouth of the container. A circumferentially continuous or segmented bead 60 extends around wall 58 radially outwardly from opening 56. A second cylindrical wall 62 extends downwardly from deck 54 coaxially with wall 58 and with the axis of skirt 30. Wall 62 has a segmented or continuous internal bead 64 that is received over bead 40 on wall 38 of base 34 for securing collar 46 and closure 24 to the closure base. A conical outer wall 66 of collar 46 extends to ledge 28 of base 22. The radially outer surface of conical wall 66 blends with and forms a continuation of the outer surface of conical wall 34 of base 22 to provide the appearance of a continuous conical wall surface. Lid 48 includes an inner cylindrical wall 68 having a circumferentially continuous or segmented radially inwardly extending bead 70 received over bead 60 on collar wall 58 to secure lid 48 in the closed position illustrated in FIGS. 1–3. Lid 48 also includes a conical outer wall 72 that extends to deck 54 in the closed position of the lid. Outer wall 72 has a conical outer surface that blends with and forms a continuation of the conical outer surfaces of wall 34 on base 22 and wall 66 on collar 46 to provide an overall continuous conical wall surface appearance to the closure in the closed position of the lid. A lug 73 projects from lid wall 72 opposite hinges 50, 52 to facilitate opening of the lid.

Figure 3:
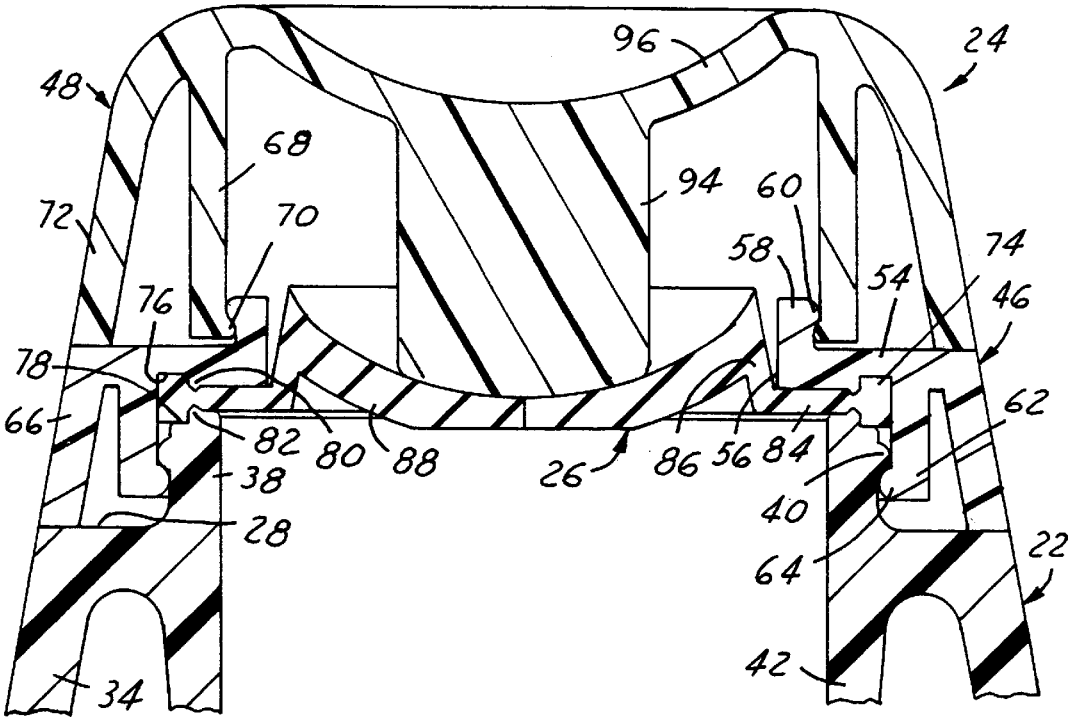
FIG. 3 is a fragmentary sectional view on an enlarged scale of a portion of the closure assembly illustrated in FIG. 2.
Figure 7:
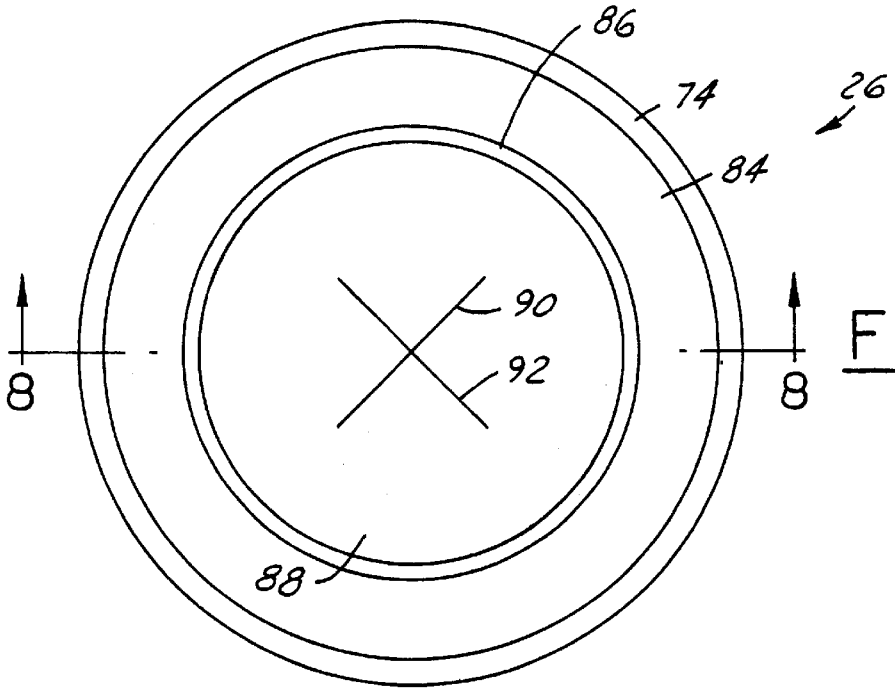
FIG. 7 is a top plan view of the dispensing valve in the closure assembly of FIGS. 3 and 4.
Figure 8:
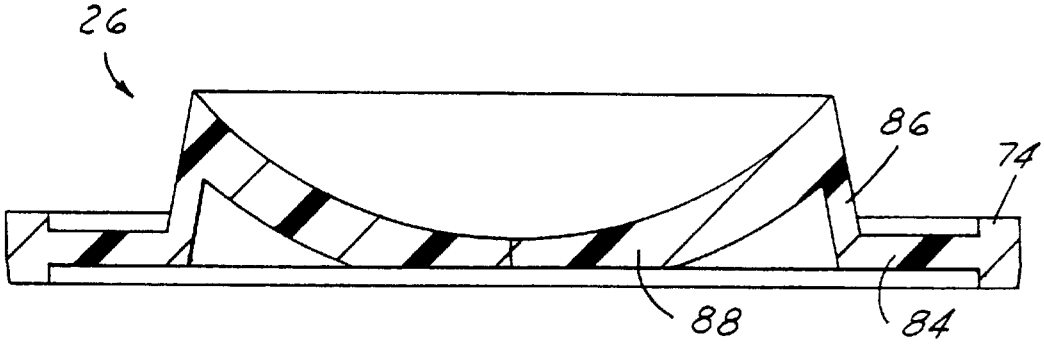
FIG. 8 is a sectional view taken substantially along the line 8—8 in FIG. 7.

Valve 26 includes a peripheral portion with a circumferentially continuous axially upwardly and downwardly extending bead 74 (FIGS. 3, 7 and 8). The upper portion of bead 74 is received within a pocket 76 on the underside of collar deck 54 adjacent to wall 62, and the lower portion of bead 74 is received within a ledge 78 at the upper outside edge of base wall 38. A pair of circumferentially continuous axially opposed beads 80, 82, on the underside of deck 54 and the upper end of wall 38, engage and pinch the peripheral portion of valve 26 radially inwardly of bead 74. A flat intermediate portion 84 of valve 26 extends radially inwardly from peripheral bead 74 underlying deck 54, and an annular wall portion 86 extends axially outwardly from the radially inner end of intermediate portion 84. Annual wall portion 86 preferably is of conical geometry in this embodiment of the invention, being positioned radially inwardly adjacent to but spaced radially inwardly from the opposing inner surface 56 of wall 58 to allow valve 26 to flex radially outwardly during opening and closing. An inwardly concave inner portion 88 of valve 26 extends radially and axially inwardly from the outer end of annular wall portion 86. A pair of crossed slits 90, 92 (FIG. 7) are formed in inner valve portion 86 for dispensing product from the container. Other slit geometries can be employed, but would be less preferred. Inner valve portion 88 is of uniform thickness except at slits 92, 94, where the inner surface is flat. A boss 94 extends axially inwardly from the base 96 of lid 48. to a position adjacent to inner portion 88 of valve 26 in the closed position of the lid.

Valve 26 is of flexible resilient elastomeric construction such as liquid silicone rubber. Closure base 22 and closure 24, including collar 46 and integrally molded lid 48, are also of molded plastic construction such as polypropylene.

Figure 4:
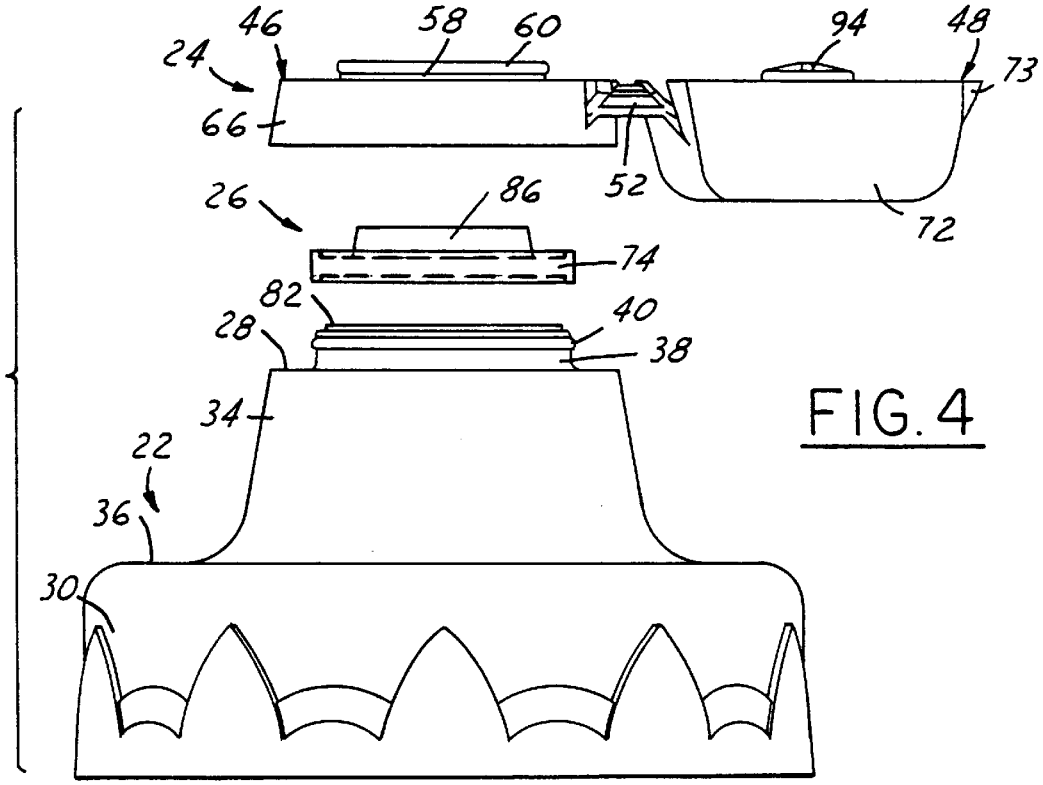
FIG. 4 is an exploded elevational view of the closure assembly in the preferred embodiment of FIGS. 1–3.
Figure 5:
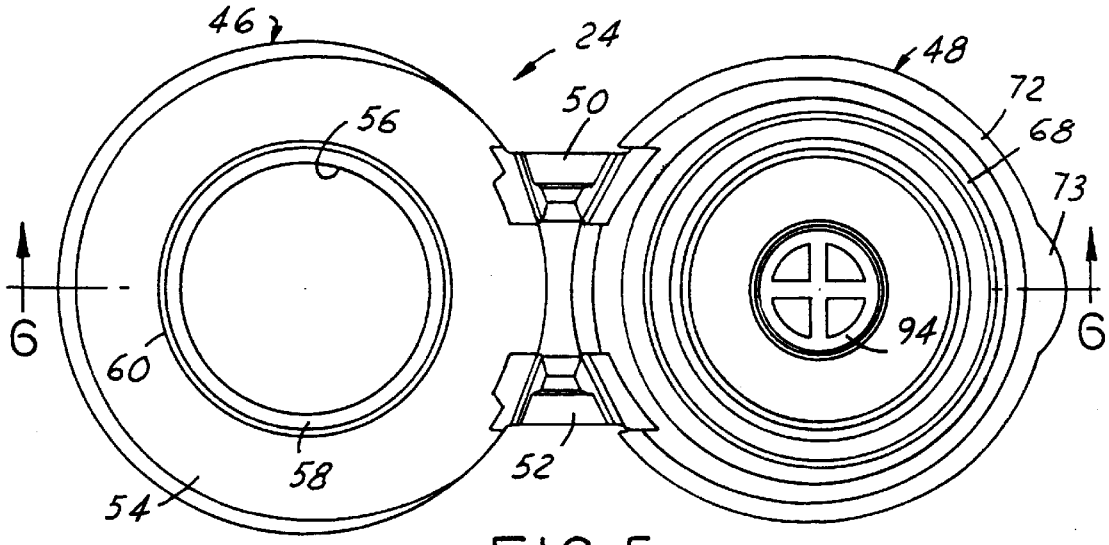
FIG. 5 is a top plan view of the closure in the closure assembly of FIGS. 3 and 4.
Figure 6:
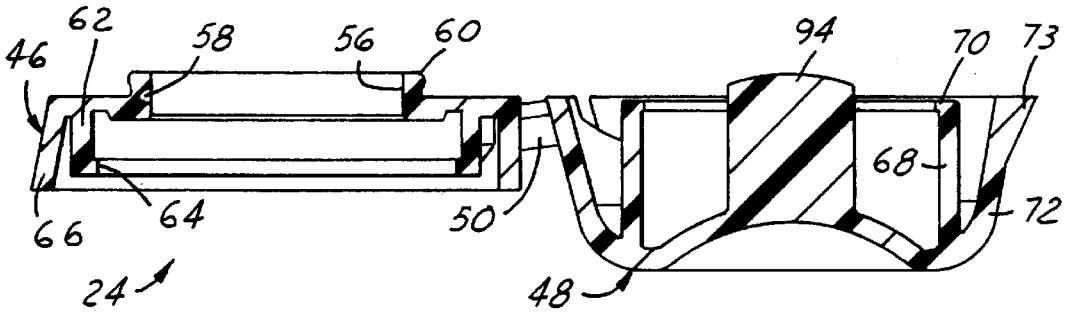
FIG. 6 is a sectional view taken substantially along the line 6—6 in FIG. 5.

Container 12 is filled with product to be dispensed, such as mustard, with closure assembly 12 removed. Closure assembly 12, which preferably is assembled separately, is then secured to the container finish. A removable sealing liner 98 (FIG. 2) may be placed over the open end of container finish 18 or within closure skirt 30 prior to securement of closure assembly 12 to the container finish. Liner 98 may comprise a layered construction, having an underlayer of plastic and a layer of metal foil, for example. The metal foil may be heated by induction to melt at least peripheral portions of the plastic layer to secure liner 98 to the end of the container finish. When package 10 is ready for use, closure assembly 12 is removed by the user and liner 98 is cut or peeled away from the container finish. Closure assembly 12 is then resecured to the container finish. With closure lid 48 pivoted to the open position illustrated in FIGS. 4–6, the package may be inverted and container body 16 squeezed to move product through wall 42 and wall 38 of closure base 22, and to push the product against inner portion 88 of valve 26. Pressure of the product against the valve urges the inner portion of the valve axially outwardly so that dispensing slits 90, 92 (FIG. 7) open and product emerges from the valve. When the desired amount of product has been dispensed, container body 16 is released and the suction of product returning to the container moves inner valve portion 88 to its original position illustrated in the drawings, closing valve slits 90, 92. Lid 48 may then be closed and snapped over collar 46. Boss 94 is positioned to prevent outward flexure of valve 26 and dispensing of product in the event that the container body is squeezed by a user with the lid closed.

Figure 9:
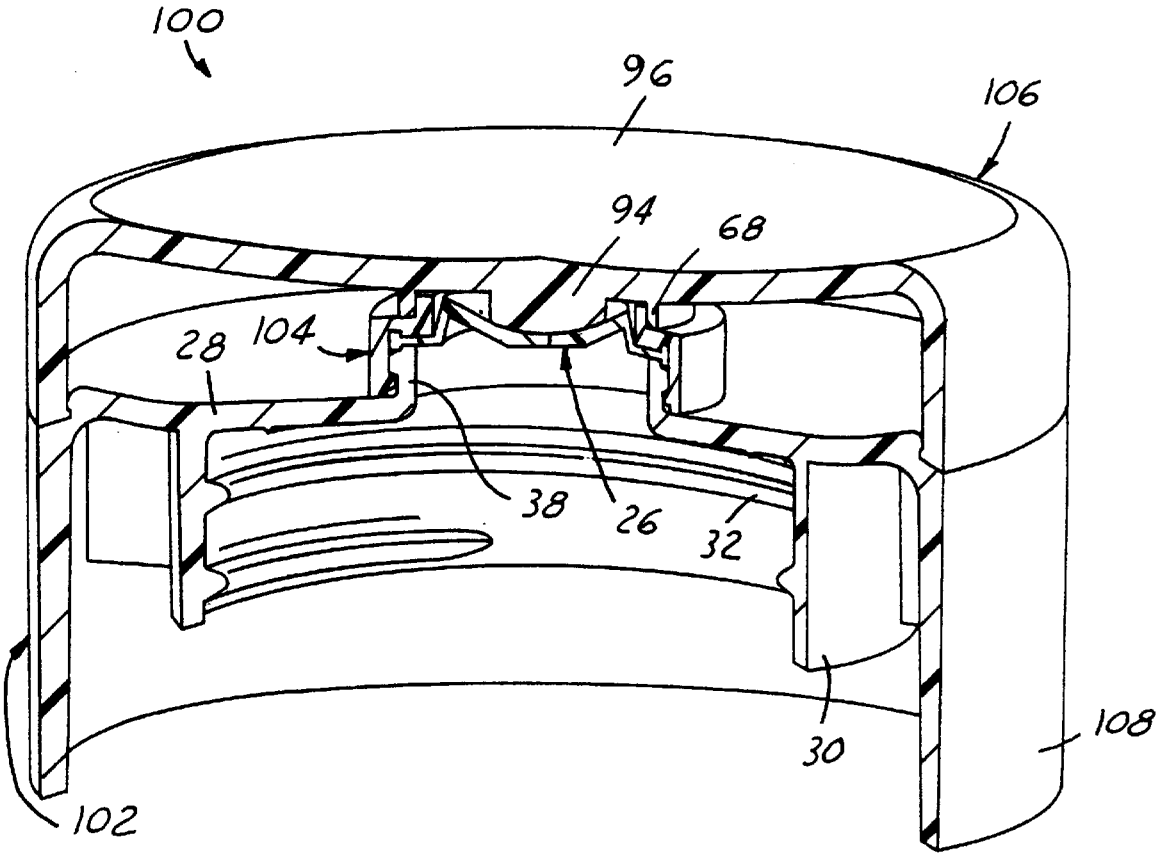
FIG. 9 is a partially sectioned elevational view of a closure assembly in accordance with another embodiment of the invention.
Figure 10:
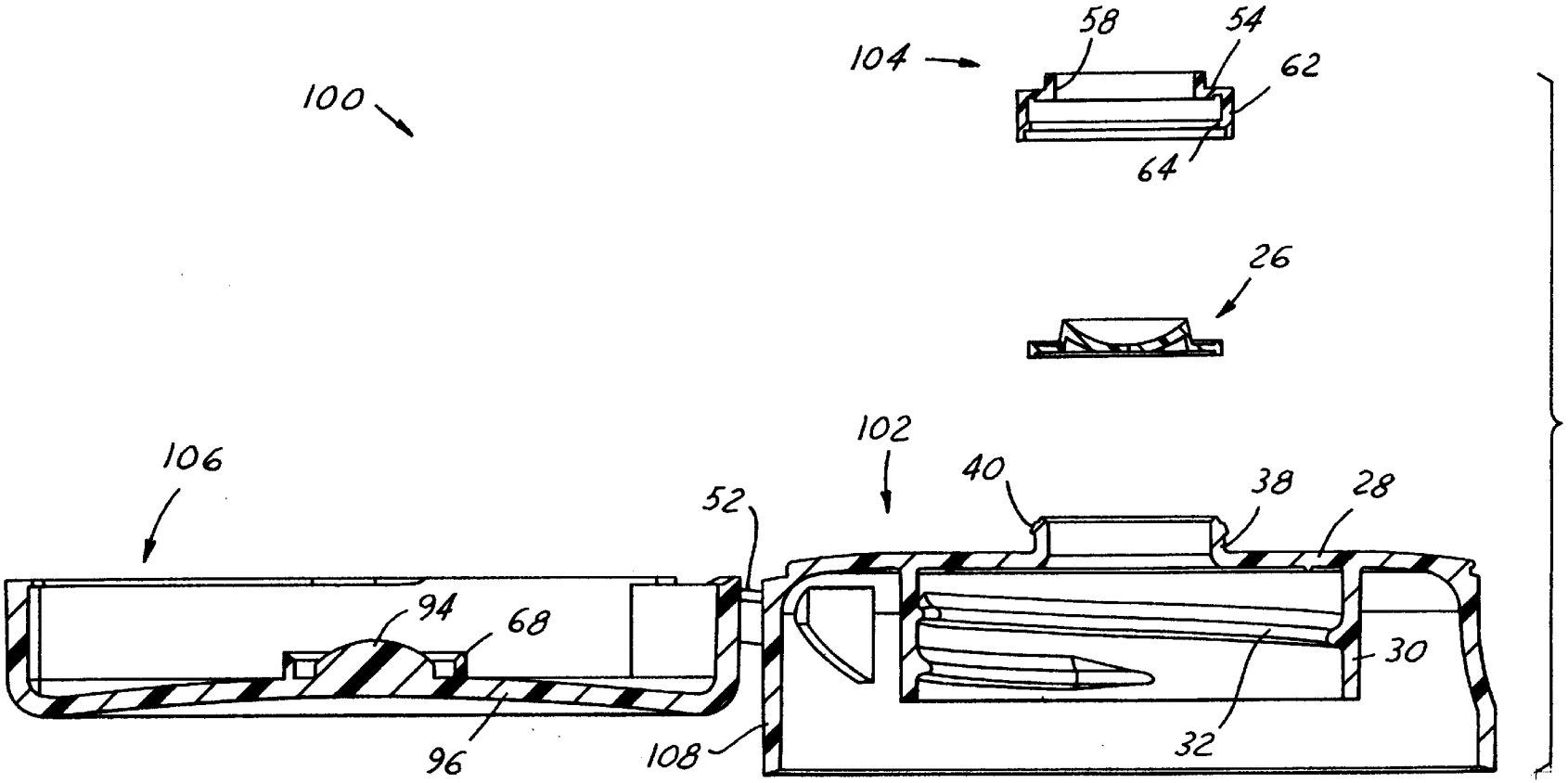
FIG. 10 is a sectioned exploded elevational view of the closure assembly illustrated in FIG. 9.

FIGS. 9 and 10 illustrate a closure assembly 100 in accordance with another embodiment of the invention. Reference numerals in FIGS. 9–10 (and FIGS. 11–12) that are identical to numerals in FIGS. 1–8 (or 9–10) indicate correspondingly identical or substantially identical components. Closure assembly 100 includes a closure base 102, a dispensing valve 26 and a collar 104. A lid 106 is integrally molded with base 102, being connected to base 102 by a pair of spaced snap hinges 52. Closure base 102 includes a cylindrical inner skirt 30 with one or more internal threads 32 for securement to a container finish, as in the embodiment of FIGS. 1–8, and an outer skirt 108 that surrounds and is spaced radially outwardly from inner skirt 30. Outer skirt 108 may be cylindrical, as shown in FIG. 9, or may be of any other suitable geometry. for matching the contour of the container to which closure assembly 100 is to be mounted. Lid 106 and hinges 52 are integrally connected to outer skirt 108 immediately beneath base wall ledge 28. As in the embodiment of FIGS. 1–8, the closure assembly may be secured to a container finish by means of one or more snap beads rather than internal threads 32.

Dispensing valve 26 is captured between collar 104 and cylindrical wall 38, which is upstanding from base wall ledge 28, as in the embodiment of FIGS. 1–8. Collar 104 has a cylindrical wall 62 with an internal bead 64 that is received by snap fit over an external bead 40 on wall 38 for securing valve 26 in position. Collar 104 also has a cylindrical wall 58 with an external bead that cooperates with an internal bead on cylindrical wall 68 of lid 106 for both securing lid 106 over base 102 in the closed position of the lid and forming a seal around valve 26. Thus, the primary differences between closure assembly 100 in FIGS. 9–10 and closure assembly 12 in FIGS. 1–8 are that the lid is integrally molded with the closure base in the embodiment of FIGS. 9–10 rather than with the valve-securing collar as in the embodiment of FIGS. 1–8, and provision of an outer skirt 108 on closure base 102 in FIGS. 9–10. The contour of base 102 (FIGS. 9–10) is also different from the contour of base 22 (FIGS. 1–8), in part due to differences in the products to be dispensed from the respective packages.

Figure 11:
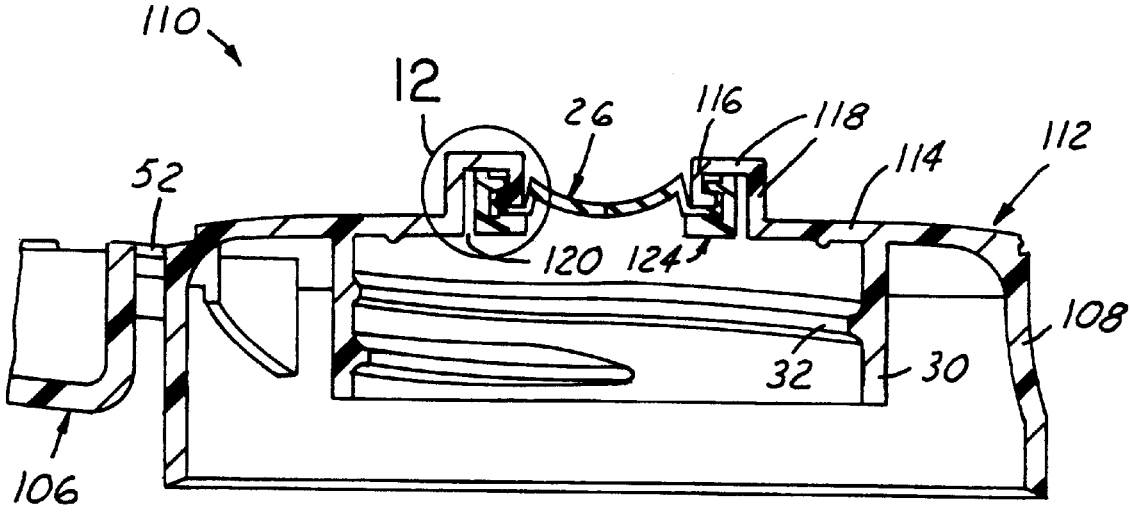
FIG. 11 is a fragmentary sectional view of a dispensing closure assembly in accordance with another embodiment of the invention.
Figure 12:
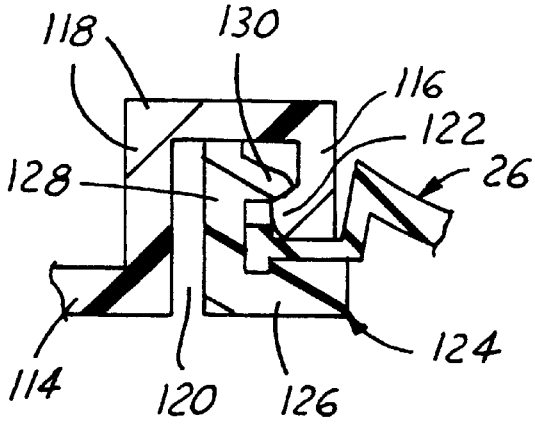
FIG. 12 is a fragmentary sectional view on an enlarged scale of the portion of FIG. 11 within the circle 12.

FIGS. 11–12 illustrate a closure assembly 110 in accordance with a third exemplary embodiment of the invention. Closure assembly 110 includes a base 112 having a base wall or ledge 114 from which an inner skirt 30 and an outer skirt 108 depend. A lid 106 is integrally coupled to base 112 by a pair of snap hinges, one of which is illustrated at 52 in FIG. 11. A cylindrical wall 116 surrounds the dispensing opening in closure assembly 110. Cylindrical wall 116 is connected to ledge 114 by wall segments 118 in such a way as to form an axially downwardly opening circumferential channel 120 radially outwardly surrounding cylindrical wall 116. A segmented or continuous bead 122 projects radially outwardly from wall 116 into channel 120. Dispensing valve 26 is secured by means of an annular retainer or collar 124 to base 112 in facing engagement with the axially facing end of wall 116. Collar 124 is generally L-shaped as viewed in radial cross section, having a deck 126 in facing engagement with the intermediate and peripheral portions of valve 26, and an annular leg 128 extending into channel 120. A segmented or continuous bead 130 projects radially inwardly from collar leg 128, and is received by snap fit over bead 122 on wall 116 so as to clamp valve 26 firmly in assembly. The undersurface of collar deck 126 is either flush with or disposed above the undersurface of ledge 114 so that a liner 98 (FIG. 2) can be positioned beneath ledge 114 within skirt 30 as previously described. The closure assembly embodiment of FIGS. 11 and 12 has the advantage over the embodiments of FIGS. 1–8 and 9–10 in that collar 124 and valve 26 cannot be readily removed by prying or other tampering from outside of the closure assembly, that is without removing the closure assembly from the container.

There have thus been disclosed a dispensing closure assembly, a dispensing package and a method of manufacture that fully achieve all of the objects and aims previously set forth. The invention has been described in conjunction with presently preferred but exemplary embodiments of the invention, and a number of modifications and variations have been discussed. Other modifications and variations will readily suggest themselves to persons of ordinary skill in the art. For example, all of the illustrated embodiments of the invention include separately formed dispensing valves 26. However, it is also contemplated in accordance with the broadest aspects of the present invention that the dispensing valve may be compression molded in situ on one of the other assembly components, such as by being compression molded in situ on collar 46 in the embodiment of FIGS. 1–8, compression molded in situ on collar 104 in the embodiment of FIGS. 9 and 10, or compression molded in situ on collar 124 in the embodiment of FIGS. 11–12. Such an in-situ compression molding operation is disclosed, for example, in U.S. Pat. No. 5,927,567. The dispensing valve could be formed on, or separately formed and adhered to, the opposing edge of cylindrical wall 38 in FIGS. 1–10 or cylindrical wall 116 in FIGS. 11–12. The dispensing valve could also be secured to the collar or the base in a multicomponent injection molding operation. The invention is intended to embrace all such modifications and variations as fall within the spirit and broad scope of the appended claims.

What is claimed is:

1. A dispensing package for fluid products, which comprises:

a container having a body for holding a product to be dispensed, and a finish extending from said body and having an open mouth, a closure base including a ledge with a skirt externally secured to said finish and a cylindrical wall extending from said ledge coaxially with said mouth, a collar having a deck with a central opening aligned with said mouth, a first cylindrical wall surrounding said opening and extending away from said mouth, and a second cylindrical wall externally surrounding and secured to said cylindrical wall on said base, a lid integrally connected to said collar or said base by at least one hinge, and a dispensing valve of flexible resilient elastomeric construction, said dispensing valve having a peripheral portion captured between said collar deck and said base cylindrical wall for securing said valve in position and simultaneously functioning as a seal between said base and said collar, an intermediate portion underlying said collar deck, an annular wall portion extending from an inner end of said intermediate portion radially inwardly adjacent to an inner surface of said first cylindrical collar wall, an inner portion extending radially inwardly from said annular wall portion, and at least one dispensing slit in said inner portion.

2. The package set forth in claim 1 wherein said closure base includes a conical outer wall extending from said skirt to said ledge.

3. The package set forth in claim 2 wherein said inner wall of said closure base is an extension of said cylindrical wall extending from said ledge.

4. The package set forth in claim 2 wherein said collar includes a conical wall spaced radially outwardly from said second cylindrical wall, said conical wall of said collar having an external surface that blends with and forms a continuation of an external surface of said conical wall of said closure base.

5. The package set forth in claim 4 wherein said lid has a conical outer wall with an external surface that blends with and forms a continuation of said external surface of said conical wall of said collar.

6. The package set forth in claim 1 wherein said closure base has an inner skirt externally secured to said container finish and an outer skirt spaced radially outwardly from said inner skirt.

7. The package set forth in claim 1 wherein said cylindrical wall on said closure base has an external bead, and said second cylindrical wall on said collar has an internal bead received over said external bead to secure said collar to said closure base.

8. The package set forth in claim 1 wherein said collar deck and said base cylindrical wall have opposed beads for sealingly pinching said peripheral portion of said valve.

9. The package set forth in claim 1 wherein said first cylindrical wall of said collar has an external bead, and said lid includes an inner wall with an internal bead for receipt over said external bead for securing said lid in a closed position over said valve.

10. The package set forth in claim 1 wherein said at least one hinge comprises a pair of snap hinges for pivoting said lid between a closed position over said first cylindrical wall and said valve, and an open position spaced from said first cylindrical wall and said valve.

11. The package set forth in claim 10 wherein said hinges integrally pivotally couple said lid to said collar.

12. The package set forth in claim 10 wherein said hinges integrally pivotally couple said lid to said base.

13. The package set forth in claim 1 wherein said annular wall portion of said valve is spaced radially inwardly from said inner surface of said second cylindrical collar wall.

14. The package set forth in claim 13 wherein said peripheral portion of said valve includes a peripheral bead captured between said collar deck and said base cylindrical wall.

15. The package set forth in claim 14 wherein said valve has crossed dispensing slits in said inner portion.

16. The package set forth in claim 1 further comprising a removable liner captured between said closure base and said container finish.

17. The package set forth in claim 1 wherein said container body is of flexible resilient construction.

18. A dispensing package for fluid products, which comprises:

a container having a body of flexible resilient construction for holding a product to be dispensed, and a finish extending from said body and having an open mouth, a closure base including a ledge with a skirt externally secured to said finish, a cylindrical wall extending from said ledge coaxially with said mouth, and an external bead around said cylindrical wall, a collar having a deck with a central opening aligned with said mouth, a first cylindrical wall surrounding said opening and extending away from said mouth, an external bead around said first cylindrical wall, and a second cylindrical wall having an internal bead surrounding and secured over said external bead on said cylindrical wall of said base, a lid integrally connected to said collar or said base by spaced hinges for pivoting between positions overlying and spaced from said first cylindrical wall, and a cylindrical wall with an internal bead on said lid for receipt over said first cylindrical wall and said external bead on said collar, and a dispensing valve of flexible resilient elastomeric construction, said dispensing valve having a peripheral portion captured in compression between said collar deck and said base cylindrical wall for securing said valve in position and simultaneously functioning as a seal between said base and said collar, an intermediate portion underlying said collar deck, an annular wall portion extending from an inner end of said intermediate portion radially inwardly adjacent to an inner surface of said first cylindrical collar wall, an inwardly concave inner portion extending radially inwardly from said annular wall portion, and at least one dispensing slit in said inner portion.

19. The package set forth in claim 18 wherein said closure base includes a conical outer wall extending from said skirt to said ledge, wherein said collar includes a conical wall spaced radially outwardly from said second cylindrical wall, said conical wall of said collar having an external surface that blends with and forms a continuation of an external surface of said conical wall of said closure base, and wherein said lid has a conical outer wall with an external surface that blends with and forms a continuation of said external surface of said conical wall of said collar.

20. The package set forth in claim 19 wherein said inner wall of said closure base is an extension of said cylindrical wall extending from said ledge.

21. The package set forth in claim 18 wherein said annular wall portion of said valve is spaced radially inwardly from said inner surface of said second cylindrical collar wall.

22. The package set forth in claim 18 wherein said closure base has an inner skirt externally secured to said container finish and an outer skirt spaced radially outwardly from said inner skirt.

23. The package set forth in claim 18 wherein said hinges integrally pivotally couple said lid to said collar.

24. The package set forth in claim 18 wherein said hinges integrally pivotally couple said lid to said base.

25. A dispensing closure assembly for fluid products, which comprises:

a closure base including a ledge with a skirt for external securement to a container finish and a cylindrical wall extending from said ledge, a collar having a deck with a central opening, a first cylindrical wall surrounding said opening, and a second cylindrical wall externally surrounding and secured to said cylindrical wall on said base, a lid integrally connected by at least one hinge to said collar or said base, and a dispensing valve of flexible resilient elastomeric construction, said dispensing valve having a peripheral portion captured in compression between said collar deck and said base cylindrical wall for securing said valve in position and simultaneously functioning as a seal between said base and said collar, an intermediate portion underlying said collar deck, an annular wall portion extending from an inner end of said intermediate portion radially inwardly adjacent to an inner surface of said first cylindrical collar wall, an inwardly concave inner portion extending radially inwardly from said annular wall portion, and at least one dispensing slit in said inner portion.

26. The closure assembly set forth in claim 25 wherein said closure base includes a conical outer wall extending from said skirt to said ledge.

27. The closure assembly set forth in claim 26 wherein said inner wall of said closure base is an extension of said cylindrical wall extending from said ledge.

28. The closure assembly set forth in claim 26 wherein said collar includes a conical wall spaced radially outwardly from said second cylindrical wall, said conical wall of said collar having an external surface that blends with and forms a continuation of an external surface of said conical wall of said closure base.

29. The closure assembly set forth in claim 28 wherein said lid has a conical outer wall with an external surface that blends with and forms a continuation of said external surface of said conical wall of said collar.

30. The closure assembly set forth in claim 25 wherein said closure base has an inner skirt for securement to a container finish and an outer skirt spaced radially outwardly from said inner skirt.

31. The closure assembly set forth in claim 25 wherein said cylindrical wall on said closure base has an external bead, and said second cylindrical wall on said collar has an internal bead received over said external bead to secure said collar to said closure base.

32. The closure assembly set forth in claim 25 wherein said collar deck and said base cylindrical wall have opposed beads for sealingly pinching said peripheral portion of said valve.

33. The closure assembly set forth in claim 25 wherein said first cylindrical wall of said collar has an external bead, and said lid includes an inner wall with an internal bead for receipt over said external bead for securing said lid in a closed position over said valve.

34. The closure assembly set forth in claim 33 wherein said at least one hinge comprises a pair of snap hinges for pivoting said lid between a closed position over said first cylindrical wall and said valve, and an open position spaced from said first cylindrical wall and said valve.

35. The closure assembly set forth in claim 34 wherein said hinges integrally pivotally couple said lid to said collar.

36. The closure assembly set forth in claim 34 wherein said hinges integrally pivotally couple said lid to said base.

37. The closure assembly set forth in claim 25 wherein said annular wall portion of said valve is spaced radially inwardly from said inner surface of said second cylindrical collar wall.

38. The closure assembly set forth in claim 37 wherein said peripheral portion of said valve includes a peripheral bead captured between said collar deck and said base cylindrical wall.

39. The closure assembly set forth in claim 38 wherein said valve has crossed dispensing slits in said inner portion.

40. A dispensing closure assembly for fluid products, which comprises:

a closure base including a ledge with a skirt, a cylindrical wall extending from said ledge, and an external bead around said cylindrical wall, a collar having a deck with a central opening, a first cylindrical wall surrounding said opening, an external bead around said first cylindrical wall, a second cylindrical wall having an internal bead surrounding and secured over said external bead on said cylindrical wall of said base, a lid integrally connected to said collar or said base by spaced hinges for pivoting between positions overlying and spaced from said first cylindrical wall and a cylindrical wall with an internal bead on said lid for receipt over said first cylindrical wall and said external bead on said collar, and a dispensing valve of flexible resilient elastomeric construction, said dispensing valve having a peripheral portion captured in compression between said collar deck and said base cylindrical wall for securing said valve in position and simultaneously functioning as a seal between said base and said collar, an intermediate portion underlying said collar deck, an annular wall portion extending from an inner end of said intermediate portion radially inwardly adjacent to an inner surface of said first cylindrical collar wall, an inwardly concave inner portion extending radially inwardly from said annular wall portion, and at least one dispensing slit in said inner portion.

41. The closure assembly set forth in claim 40 wherein said closure base includes a conical outer wall extending from said skirt to said ledge, wherein said collar includes a conical wall spaced radially outwardly from said second cylindrical wall, said conical wall of said collar having an external surface that blends with and forms a continuation of an external surface of said conical wall of said closure base, and wherein said lid has a conical outer wall with an external surface that blends with and forms a continuation of said external surface of said conical wall of said collar.

42. The closure assembly set forth in claim 41 wherein said inner wall of said closure base is an extension of said cylindrical wall extending from said ledge.

43. The closure assembly set forth in claim 41 wherein said annular wall portion of said valve is spaced radially inwardly from said inner surface of said second cylindrical collar wall.

44. The closure assembly set forth in claim 40 wherein said closure base has an inner skirt for securement to a container finish and an outer skirt spaced radially outwardly from said inner skirt.

45. The closure assembly set forth in claim 40 wherein said hinges integrally pivotally couple said lid to said collar.

46. The closure assembly set forth in claim 40 wherein said hinges integrally pivotally couple said lid to said base.

47. A method of making a dispensing closure assembly for fluid products, which comprises the steps of:

(a) providing a closure base of molded plastic construction that includes a ledge with a skirt for external securement to a container finish, a cylindrical wall extending from said ledge and a bead around said cylindrical wall, (b) placing against an end of said cylindrical wall a dispensing valve of flexible resilient elastomeric construction having a peripheral portion engaged with an end of said cylindrical wall, an intermediate portion, an annular wall portion extending from an inner end of said intermediate portion, a concave inner portion extending radially inwardly from said annular wall portion, and at least one dispensing slit in said inner portion, (c) securing a collar to said cylindrical wall of said closure base, said collar having a deck opposed to and engaged with said peripheral and intermediate portions of said valve such that said peripheral portion of said valve functions as a seal between said base and said collar, and a bead secured over said bead on said cylindrical wall of said base, and (d) integrally connecting a lid to said collar or said base by spaced hinges for pivoting between positions overlying and spaced from said first valve.

48. A dispensing package for fluid products, which comprises:

a container having a body for holding a product to be dispensed, and a finish extending from said body and having an open mouth, a closure base including a ledge with a skirt externally secured to said finish and a wall extending from said ledge coaxially with said mouth, a collar having a deck with a central opening aligned with said mouth and a wall secured to said wall on said base, a lid integrally connected to said collar or said base by at least one hinge, and a dispensing valve of flexible resilient elastomeric construction, said dispensing valve having a peripheral portion captured between said collar deck and said wall on said base for securing said valve in position and simultaneously functioning as a seal between said base and said collar, an intermediate portion in facing engagement with said collar deck, an annular wall portion extending from an inner end of said intermediate portion, an inner portion extending radially inwardly from said annular wall portion, and at least one dispensing slit in said inner portion.

49. The package set forth in claim 48 wherein said collar is externally secured to said wall on said base on a side of said ledge remote from said mouth.

50. The package set froth in claim 49 wherein said collar has a second wall surrounding said opening and extending away from said mouth, and wherein said annular wall portion of said valve is radially inwardly adjacent to an inner surface of said second wall.

51. The package set forth in claim 50 wherein said walls on said base and said collar are cylindrical.

52. The package set forth in claim 48 wherein said collar is internally secured to said wall on said base on a side of said ledge adjacent to said mouth.

53. The package set forth in claim 52 wherein said wall on said base forms a channel and said collar is secured to said wall within said channel.

54. The package set forth in claim 53 wherein said wall has a bead that extends into said channel and said collar is snapped over said bead.

55. A dispensing closure assembly for fluid products, which comprises:

a closure base including a ledge with a skirt for external securement to a container finish and a wall extending from said ledge, a collar having a deck with a central opening, and a wall externally surrounding and secured to said wall on said base, a lid integrally connected by at least one hinge to said collar or said base, and a dispensing valve of flexible resilient elastomeric construction, said dispensing valve having a peripheral portion captured between said collar deck and said base wall for securing said valve in position and simultaneously functioning as a seal between said base and said collar, an intermediate portion in facing engagement with said collar deck, an annular wall portion extending from an inner end of said intermediate portion, an inner portion extending radially inwardly from said annular wall portion, and at least one dispensing slit in said inner portion.

56. The closure assembly set forth in claim 55 wherein said collar is externally secured to said wall on said base.

57. The closure assembly set forth in claim 56 wherein said collar has a second wall surrounding said opening, and wherein said annular wall portion of said valve is radially inwardly adjacent to an inner surface of said second wall.

58. The closure assembly set forth in claim 57 wherein said walls on said base and said collar are cylindrical.

59. The closure assembly set forth in claim 55 wherein said collar is internally secured to said wall on said base.

60. The closure assembly set forth in claim 59 wherein said wall on said base forms a channel and said collar is secured to said wall within said channel.

61. The closure assembly set forth in claim 60 wherein said wall has a bead that extends into said channel and said collar is snapped over said bead.

62. A dispensing package for fluid products, which comprises:

a container having a body for holding a product to be dispensed, and a finish extending from said body and having an open mouth, a closure base including a ledge with a skirt externally secured to said finish, and a cylindrical wall extending from said ledge coaxially with said mouth and forming a channel that opens toward said mouth, a collar having a deck with a central opening aligned with said mouth, and a cylindrical wall secured within said channel to said cylindrical wall on said base, a lid integrally connected to said base by at least one hinge, and a dispensing valve of flexible resilient elastomeric construction, said dispensing valve having a peripheral portion captured in compression between said collar deck and said base cylindrical wall for securing said valve in position and simultaneously functioning as a seal between said base and said collar, an intermediate portion in facing engagement with said collar deck, an annular wall portion extending from an inner end of said intermediate portion radially inwardly adjacent to an inner surface of said cylindrical wall on said base, an inner portion extending radially inwardly from said annular wall portion, and at least one dispensing slit in said inner portion.

63. The package set forth in claim 62 wherein said wall on said base has a bead that extends radially outwardly into said channel, and said collar has a radially inwardly extending bead that is received by snap fit over said bead on said base.

64. The package set forth in claim 63 wherein said ledge has an undersurface and said deck has an undersurface that is either flush with said undersurface of said ledge or disposed on a side of said undersurface of said ledge away from said mouth.

65. The package set forth in claim 62 wherein said closure base has an inner skirt externally secured to said container finish and an outer skirt spaced radially outwardly from said inner skirt.

66. The package set forth in claim 62 wherein said at least one hinge comprises a pair of snap hinges for pivoting said lid between a closed position over said valve and an open position spaced from said valve.

67. The package set forth in claim 66 wherein said hinges integrally pivotally couple said lid to said base.

68. The package set forth in claim 62 wherein said annular wall portion of said valve is spaced radially inwardly from an inner surface of said cylindrical wall on said base.

69. The package set forth in claim 68 wherein said peripheral portion of said valve includes a peripheral bead captured between said collar deck and said base cylindrical wall.

70. The package set forth in claim 69 wherein said valve has crossed dispensing slits in said inner portion.

71. The package set forth in claim 62 further comprising a removable liner captured between said closure base and said container finish.

72. The package set forth in claim 62 wherein said container body is of flexible resilient construction.

73. A dispensing closure assembly for fluid products, which comprises:

a closure base including a ledge with a skirt for external securement to a container finish, and a cylindrical wall extending from said ledge and forming a channel that opens axially of said base, a collar having a deck with a central opening, and a cylindrical wall secured within said channel to said cylindrical wall on said base, a lid integrally connected by at least one hinge to said base, and a dispensing valve of flexible resilient elastomeric construction, said dispensing valve having a peripheral portion captured between said collar deck and said base cylindrical wall for securing said valve in position and simultaneously functioning as a seal between said base and said collar, an intermediate portion in facing engagement with said collar deck, an annular wall portion extending from an inner end of said intermediate portion radially inwardly adjacent to an inner surface of said cylindrical wall on said base, an inner portion extending radially inwardly from said annular wall portion, and at least one dispensing slit in said inner portion.

74. The closure assembly set forth in claim 73 wherein said wall on said base has a bead that extends radially outwardly into said channel, and said collar has a radially inwardly extending bead that is received by snap fit over said bead on said base.

75. The closure assembly set forth in claim 74 wherein said ledge has an undersurface and said deck has an undersurface that is either flush with said undersurface of said ledge or disposed on a side of said undersurface of said ledge away from said mouth.

76. The closure assembly set forth in claim 73 wherein said closure base has an inner skirt for securement to a container finish and an outer skirt spaced radially outwardly from said inner skirt.

77. The closure assembly set forth in claim 73 wherein said at least one hinge comprises a pair of snap hinges for pivoting said lid between a closed position over said valve and an open position spaced from said valve.

78. The closure assembly set forth in claim 77 wherein said hinges integrally pivotally couple said lid to said base.

79. The closure assembly set forth in claim 73 wherein said annular wall portion of said valve is spaced radially inwardly from an inner surface of said collar wall.

80. The closure assembly set forth in claim 79 wherein said peripheral portion of said valve includes a peripheral bead captured between said collar deck and said base cylindrical wall.

81. The closure assembly set forth in claim 80 wherein said valve has crossed dispensing slits in said inner portion.

* * * * *